US005709116A

United States Patent [19]

Rieger et al.

[11] Patent Number: 5,709,116

[45] Date of Patent: Jan. 20, 1998

[54] HYDRAULIC CRIMPER AND BOLT ASSEMBLY

[75] Inventors: Frank W. Rieger, Pittsburgh, Pa.; David Lee Rousar, San Jose, Calif.

[73] Assignee: General Electric Company, Schenectady, N.Y.

[21] Appl. No.: 608,637

[22] Filed: Feb. 29, 1996

[51] Int. Cl.[6] ..... B21D 26/02; B21D 39/20

[52] U.S. Cl. ..... 72/57; 72/54; 411/121; 411/116

[58] Field of Search ..... 72/54, 56, 57, 72/61, 62, 58, 55; 411/116, 120, 121, 129, 122, 117

[56] References Cited

U.S. PATENT DOCUMENTS

| | | | |
|---|---|---|---|
| 3,564,884 | 2/1971 | Hinshaw | 72/57 |
| 4,723,430 | 2/1988 | Hahn | 72/54 |
| 4,938,644 | 7/1990 | Runels | 411/120 |
| 4,976,576 | 12/1990 | Mahaney, Jr. et al. | 411/129 |
| 5,360,303 | 11/1994 | Behrens et al. | 411/120 |
| 5,586,790 | 12/1996 | Bynum | 411/121 |

FOREIGN PATENT DOCUMENTS

| | | | |
|---|---|---|---|
| 564732 | 10/1993 | European Pat. Off. | 72/62 |

*Primary Examiner*—David Jones

*Attorney, Agent, or Firm*—Armstrong, Teasdale, Schlafly & Davis

[57] ABSTRACT

A bolt and keeper assembly including a crimper for crimping a portion of the keeper into pockets formed in an upper portion of the bolt head are described. The crimper includes a hydraulic cylinder for carrying hydraulic fluid under pressure and a crimper body having a bore extending therethrough. The bore has first and second end portions and an intermediate portion extending between the first and second end portions. The first end portion of the crimper body bore is configured to receive an end portion of the hydraulic cylinder, and the second portion of the crimper body bore is configured to receive at a least a portion of the bolt head and keeper assembly. When assembled, an upper portion of the bolt head and keeper assembly extends into the intermediate bore portion. A compressible ring is positioned in the intermediate portion of the crimper body bore at a location to engage the keeper and for crimping sections of the keeper into the bolt head pockets.

14 Claims, 1 Drawing Sheet

HYDRAULIC CRIMPER AND BOLT ASSEMBLY

FIELD OF THE INVENTION

This invention relates generally to mechanical fasteners and, more particularly, to a hydraulic crimper for use in connection with a bolt and keeper assembly for securing the bolt to withstand vibration and thermal ratchet.

BACKGROUND OF THE INVENTION

In a nuclear reactor environment, fasteners including bolts typically are subject to vibration and thermal ratcheting. Such vibration and thermal ratcheting could cause the bolt to loosen. Of course, it generally is undesirable to have a bolt loosen if the bolt is intended to maintain engagement between structures in a nuclear reactor.

Also, in a nuclear reactor environment, apparatus for performing operations on bolt heads typically must be capable of operating underwater. For example, some bolts may be located thirty (30) feet underwater. Therefore, the apparatus must be submerged in the water and delivered to the bolt head site.

Known crimpers used to facilitate ensuring that bolts are secure against vibration generally include multiple moving parts and are difficult to fabricate. Such crimpers also are difficult to maintain. In addition, with known crimpers, the crimper typically must have a specific orientation for mating with a bolt. Especially in an underwater application, it is difficult to orient the crimper within specific limited tolerances.

It therefore would be desirable to provide a crimper that has only a few movable parts and is relatively easy to maintain. It also would be desirable to provide a crimper that does not require a specific limited tolerance orientation for mating with a bolt.

SUMMARY OF THE INVENTION

These and other objects are attained by a hydraulic crimper and bolt assembly configured for crimping a keeper into engagement with the bolt to prevent the bolt from loosening due to vibration and thermal ratcheting. More specifically, in one embodiment, the bolt has a threaded body portion, and a bolt head portion is located at one end of the threaded body portion. The bolt head portion has a diameter greater than the diameter of the threaded body portion. A plurality of pockets are formed in the bolt head portion. The bolt also includes a bolt head flange located at an end of the bolt head portion opposite the threaded body portion. The bolt head flange has a diameter greater than the diameter of the bolt head portion.

The assembly also includes a keeper having a bore extending therethrough. A first portion of the keeper bore is sized to have the threaded body portion of the bolt substantially pass therethrough. A second portion of the keeper bore is sized to substantially receive the bolt head portion. An end surface of the keeper at an open end of the keeper bore second portion is sized to be positioned adjacent, but spaced from, the bolt head flange.

The hydraulic crimper includes a hydraulic cylinder for carrying hydraulic fluid under pressure. The crimper further includes a crimper body having a bore extending therethrough. The crimper body bore has first and second end portions and an intermediate portion extending between the first and second end portions. The first end portion of the crimper body bore is configured to receive an end portion of the hydraulic cylinder. The second end portion of the crimper body bore is configured to receive at a least a portion of the bolt head portion and the keeper. An upper portion of the bolt head and the keeper extend into the crimper body bore intermediate portion when the bolt and keeper assembly is positioned for a crimping operation. To facilitate underwater operations, a bracket and handling pole adapter assembly is secured to the crimper body.

A compressible ring is positioned in the intermediate portion of the crimper body bore. A plunger is positioned in the intermediate portion of the crimper body bore and is movable into contact with the ring so that when hydraulic fluid under pressure is delivered from the hydraulic cylinder to the crimper body, the plunger is forced against the ring with sufficient force so that the ring deforms and crimps sections of the keeper into the bolt head pockets.

By crimping the keeper into engagement with the bolt head, the keeper facilitates keeping the bolt tightened even when subjected to vibration and thermal ratcheting. Such an arrangement is particularly beneficial in a nuclear reactor environment where such vibrations and thermal ratcheting may be significant. Further, the hydraulic crimper is operable underwater and can be positioned to perform the crimping operations on underwater bolts. Moreover, the above described crimper has only a few movable parts and is relatively easy to maintain. The crimper also does not require a specific limited tolerance orientation for mating with the bolt head.

DETAILED DESCRIPTION OF THE DRAWINGS

Figure 1:
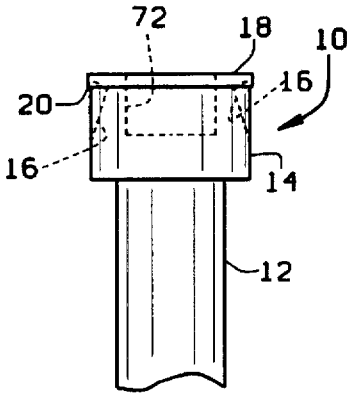
FIG. 1 is a side view of a bolt in accordance with one embodiment of the present invention.

FIG. 1 is a side view of a bolt 10 in accordance with one embodiment of the present invention. Bolt 10 includes a threaded body portion 12 and a bolt head portion 14 located at one end of threaded body portion 12. Bolt head portion 14 has a diameter greater than the diameter of threaded body portion 12. A plurality of pockets 16 are formed in bolt head portion 14.

A bolt head flange 18 is located at an end 20 of bolt head portion 14 opposite threaded body portion 12. Bolt head flange 18 has a diameter greater than the diameter of bolt head portion 14. Flange 18 is configured to form an interference fit with a compressible ring of a crimper (not shown in FIG. 1) when the compressible ring is compressed for preventing disengagement of bolt head portion 14 from the crimper. A hex wrench opening 22 is formed in bolt head flange 18 and at least partially through bolt head portion 14.

Figure 2:
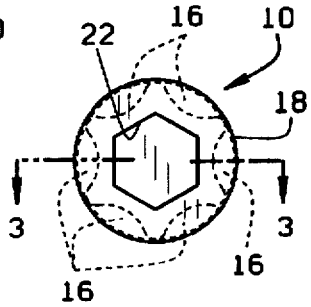
FIG. 2 is a top view of the bolt shown in FIG. 1.

FIG. 2 is a top view of bolt 10 shown in FIG. 1. As clearly shown in FIG. 2, a plurality of pockets 16 are formed at the periphery of bolt head portion 14. Also, hex wrench opening 22 extends through the top of bolt 10 so that an external hex wrench (not shown) can be used to initially tighten bolt 10 into its desired position.

Figure 3:
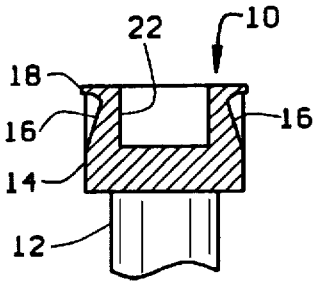
FIG. 3 is a cross-section view through line 3—3 shown in FIG. 2.

FIG. 3 is a cross-section view through line 3—3 shown in FIG. 2. The general tear drop shape of pockets 16 is clearly shown in FIG. 3. Such configuration facilitates securely crimping section of the keeper (not shown in FIG. 3) into pockets 16 to prevent bolt 10 from loosening once bolt 10 is tightened into position.

Figure 4:
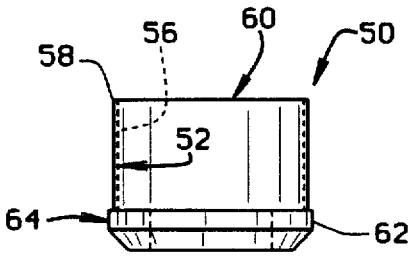
FIG. 4 is a side view of a keeper in accordance with one embodiment of the present invention.

FIG. 4 is a side view of a keeper 50 in accordance with one embodiment of the present invention. Keeper 50 has a bore 52 extending therethrough. A first portion 54 of keeper bore 52 is sized to have threaded body portion 12 (FIG. 1) substantially pass therethrough. A second portion 56 of keeper bore 52 is sized to substantially receive bolt head portion 14 (FIG. 1). An end surface 58 of keeper 50 at an open end 60 of bore second portion 56 is sized to be adjacent, but spaced from, bolt head flange 18 (FIG. 1). A keeper flange 62 is located at a lower portion 64 of keeper 50.

Figure 5:
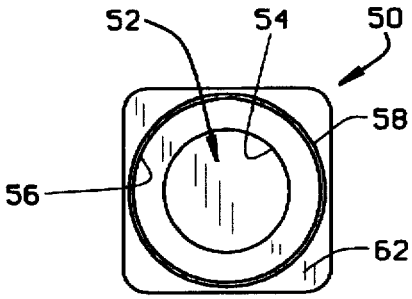
FIG. 5 is a top view of the keeper shown in FIG. 4.

FIG. 5 is a top view of keeper 50 shown in FIG. 4. First and second portions 54 and 56 of keeper bore 52 have a substantially cylindrical shape. Keeper flange 62 has a substantially square shape.

To assemble keeper 50 to bolt 10, threaded portion 12 of bolt 10 is passed through first portion 54 of bore 52 until end surface 58 of keeper 50 is adjacent, but spaced from, bolt head flange 18. When assembled as described above, sections of keeper 50 are aligned with pockets 16 so that such keeper sections can be crimped into pockets 16 as described below.

Figure 6:
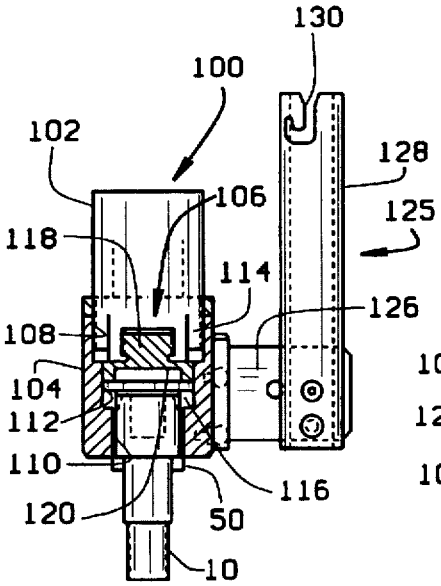
FIG. 6 is a side view of a hydraulic crimper in accordance with one embodiment of the present invention.

FIG. 6 is a side view of a hydraulic crimper 100 in accordance with one embodiment of the present invention. As described above, crimper 100 is configured for crimping a sections of keeper 50 (FIG. 4) into pockets 16 formed in bolt head portion 14 (FIG. 1). Keeper 50 and bolt 10 are shown in FIG. 6 as being operatively positioned so that portions, or sections, of keeper 50 to be crimped into bolt head pockets 16 are aligned.

Crimper 100 includes a hydraulic cylinder 102 for carrying hydraulic fluid under pressure to a crimper body 104. Crimper body 104 has a bore 106 extending therethrough. Bore 106 has first and second end portions 108 and 110 and an intermediate portion 112 extending between first and second end portions 108 and 110. First end portion 108 of crimper body bore 106 is configured to receive an end portion 114 of hydraulic cylinder 102. Second end portion 110 of crimper body bore 106 is configured to receive at a least a portion of bolt head 10 and keeper 50 assembly so that an upper portion thereof can extend into bore intermediate portion 112.

A compressible ring 116 is positioned in intermediate portion 112 of crimper body bore 106 for crimping sections of keeper 50 into bolt head pockets 16. A plunger 118 is positioned in intermediate portion 112 of crimper body bore 106 and is movable into contact with ring 116 so that when hydraulic fluid under pressure is delivered from hydraulic cylinder 102 to crimper body 104, plunger 118 is forced against ring 116 with sufficient force so that ring 116 crimps sections of keeper 50 into bolt head pockets 16. A cylindrical bore 120 extends partially plunger 118 so that a portion of bolt 10 and keeper 50 is at least partially positioned within plunger bore 120 as plunger 118 is forced against ring 116. Such a configuration provides that plunger 118 does not exert a direct force against bolt 10 and keeper 50. End portion 114 of hydraulic cylinder 102 is threaded and a threaded locking nut 124 is provided for threadedly engaging hydraulic cylinder end portion 114 to facilitate maintaining hydraulic cylinder 102 in engagement with crimper body 104.

A bracket and handling pole adapter assembly 125 is secured to crimper body 104. Assembly 125 includes a bracket 126 secured to body 104 and a pole adapter 128 threadedly engaged to bracket 126. Pole adapter 128 includes engagement openings 130 configured to mate with a handling pole (not shown) typically used in a nuclear reactor environment when performing underwater operations.

Figure 7:
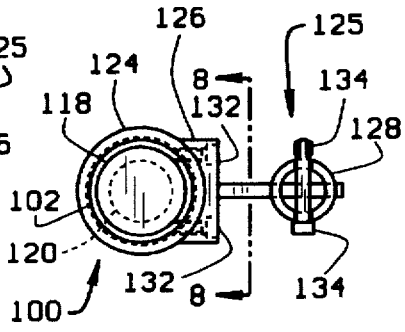
FIG. 7 is a top view of the crimper shown in FIG. 6.

FIG. 7 is a top view of crimper 100 shown in FIG. 6. As shown in FIG. 7, bracket 126 is secured to crimper body 104 by threaded bolts 132. Pole adapter 128 is secured to adapter 126 by threaded bolts 134.

Figure 8:
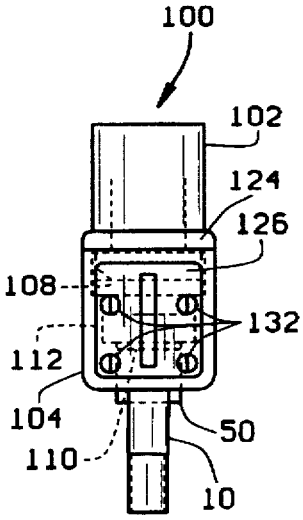
FIG. 8 is a cross-section view through line 8—8 shown in FIG. 7.

FIG. 8 is a cross-section view through line 8—8 shown in FIG. 7. As shown in FIG. 8, four bolts 132 are used to secure bracket 126 to crimper body 104.

To perform a crimping operation, bolt 10 is assembled in keeper 50 so that threaded body portion 12 of bolt 10 is substantially passed through first portion 54 of keeper bore 52 and bolt head portion 14 of bolt 10 is substantially positioned in keeper second portion 56. When so assembled, end surface 58 of keeper 50 at open end 60 of bore second portion 56 is adjacent, but spaced from, bolt head flange 18. Also, sections of keeper 50 are aligned with pockets 16 so that such keeper sections can be crimped into pockets 16.

Assembled bolt 10 and keeper 50 are then inserted into second end portion 110 of bore 106 as shown in FIG. 6. When so assembled, at least a portion of bolt head 10 and keeper 50 are positioned so that an upper portion thereof extends into bore intermediate portion 112 adjacent compressible ring 116. Also, keeper flange 62 abuts against a lower surface of crimper body 104.

Once bolt 10, keeper 50 and crimper 100 are positioned as described above, pressurized hydraulic fluid can be delivered through hydraulic cylinder 102 and force plunger 118 into contact with ring 116. Plunger 118 is forced against ring 116 with sufficient force so that ring 116 deforms and crimps sections of keeper 50 into bolt head pockets 16. Cylindrical bore 120 of plunger 118 provides that plunger 118 does not exert a direct force against bolt 10 and keeper 50. Also, flange 18 of bolt 10 and compressible ring 116, when compressed, form an interference fit for preventing disengagement of bolt 10 from crimper body 104 during a crimping operation.

Once keeper 50 has been crimped, then hydraulic forces are removed by releasing, or at least reducing, the pressure on hydraulic fluid. Plunger 118 therefore releases the pressure on ring 116. Once ring 116 is no longer compressed, crimper 100 can be removed from its position over bolt 10.

As a result of the crimping operations, keeper 50 is securely engaged to bolt 10. Keeper 50 facilitates keeping bolt 10 tightened even when subjected to vibration and thermal ratcheting. Such an arrangement is particularly beneficial in a nuclear reactor environment where such vibrations and thermal ratcheting may be significant. Further, hydraulic crimper 100 is operable underwater and can be easily positioned to perform the crimping operations even on underwater bolts. Moreover, crimper 100 has only a few movable parts and is relatively easy to maintain.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A hydraulic crimper for crimping a portion of a keeper into pockets formed in an upper portion of a bolt head, the keeper and bolt head arranged in an assembly so that portions of the keeper to be crimped into the bolt head pockets are aligned, said crimper comprising:

a hydraulic cylinder for carrying hydraulic fluid under pressure;

a crimper body having a bore extending therethrough, said bore having first and second end portions and an intermediate portion extending between said first and second end portions, said first end portion of said crimper body bore configured to receive an end portion of said hydraulic cylinder, said second end portion of said crimper body bore configured to receive at a least a portion of the bolt head and keeper assembly so that an upper portion of the bolt head and keeper assembly can extend into said bore intermediate portion;

a compressible ring positioned in said intermediate portion of said crimper body bore for crimping sections of the keeper into the bolt head pockets;

a plunger positioned in said intermediate portion of said crimper body bore and movable into contact with said ring so that when hydraulic fluid under pressure is delivered from said hydraulic cylinder to said crimper body, said plunger is forced against said ring with sufficient force so that said ring crimps sections of the keeper into the bolt head pockets; and a bracket and handling pole adapter assembly secured to said crimper body.

2. A hydraulic crimper in accordance with claim 1 wherein said end portion of said hydraulic cylinder is threaded and said crimper further comprises a threaded locking nut for threadedly engaging said hydraulic cylinder end portion to facilitate maintaining said hydraulic cylinder in engagement with said crimper body.

3. A hydraulic crimper in accordance with claim 1 wherein said plunger has a cylindrical bore extending partially therethrough, said plunger bore sized so that a portion of the bolt and keeper assembly is at least partially positioned within said plunger bore as said plunger is forced against said ring so that said plunger does not exert a direct force against the keeper and bolt assembly.

4. A hydraulic crimper in accordance with claim 1 wherein a flange is formed integral with the top of the bolt head and wherein said compressible ring, when compressed, forms an interference fit with the bolt head flange for preventing disengagement of the bolt from said crimper body during a crimping operation.

5. A bolt assembly, comprising:

a threaded body portion;

a bolt head portion located at one end of said threaded body portion, said bolt head portion having a diameter greater than the diameter of said threaded body portion, at least one pocket formed in said bolt head portion;

a bolt head flange located at an end of said bolt head portion opposite said threaded body portion, said bolt head flange having a diameter greater than the diameter of said bolt head portion, said flange configured to form an interference fit with a compressible ring of a crimper when the compressible ring is compressed for preventing disengagement of said bolt head portion from the crimper; and a keeper having a bore extending therethrough, a first portion of said keeper bore sized to have said threaded body portion substantially pass therethrough, a second portion of said keeper bore sized to substantially receive said bolt head portion.

6. A bolt assembly in accordance with claim 5 wherein said keeper further comprises a keeper flange at a lower portion thereof.

7. A bolt assembly in accordance with claim 6 wherein said keeper flange has a substantially square shape.

8. A bolt assembly in accordance with claim 5 further comprising a hex wrench opening in said bolt head flange and at least partially through said bolt head portion.

9. A bolt assembly in accordance with claim 5 wherein a plurality of pockets are formed in said bolt head portion.

10. A hydraulic crimper and bolt assembly, comprising:

a bolt comprising a threaded body portion, a bolt head portion located at one end of said threaded body portion, said bolt head portion having a diameter greater than the diameter of said threaded body portion, at least one pocket formed in said bolt head portion, and a bolt head flange located at an end of said bolt head portion opposite said threaded body portion, said bolt head flange having a diameter greater than the diameter of said bolt head portion;

a keeper having a bore extending therethrough, a first portion of said keeper bore sized to have said threaded body portion substantially pass therethrough, a second portion of said keeper bore sized to substantially receive said bolt head portion;

a hydraulic cylinder for carrying hydraulic fluid under pressure;

a crimper body having a bore extending therethrough, said crimper body bore having first and second end portions and an intermediate portion extending between said first and second end portions, said first end portion of said crimper body bore configured to receive an end portion of said hydraulic cylinder, said second end portion of said crimper body bore configured to receive at a least a portion of said bolt head portion and said keeper, an upper portion of said bolt head and said keeper extending into said crimper body bore intermediate portion;

a compressible ring positioned in said intermediate portion of said crimper body bore for crimping a section of said keeper into said bolt head pocket; and a plunger positioned in said intermediate portion of said crimper body bore and movable into contact with said ring so that when hydraulic fluid under pressure is delivered from said hydraulic cylinder to said crimper body, said plunger is forced against said ring with sufficient force so that said ring crimps said section of said keeper into said bolt head pocket.

11. A hydraulic crimper and bolt assembly in accordance with claim 10 wherein said end portion of said hydraulic cylinder is threaded and further comprising a threaded locking nut for threadedly engaging said hydraulic cylinder end portion to facilitate maintaining said hydraulic cylinder in engagement with said crimper body.

12. A hydraulic crimper and bolt assembly in accordance with claim 10 wherein said plunger has a cylindrical bore extending partially therethrough, said plunger bore sized so that a portion of said bolt and said keeper is at least partially positioned within said plunger bore as said plunger is forced against said ring so that said plunger does not exert a direct force against said keeper and said bolt.

13. A hydraulic crimper and bolt assembly in accordance with claim 10 wherein said compressible ring, when compressed, forms an interference fit with said bolt head flange for preventing disengagement of said bolt from said crimper body.

14. A hydraulic crimper and bolt assembly in accordance with claim 10 further comprising a bracket and handling pole adapter assembly secured to said crimper body.

* * * * *